US010407855B2

(12) United States Patent
Cook

(10) Patent No.: US 10,407,855 B2
(45) Date of Patent: Sep. 10, 2019

(54) K RAIL END CAP

(71) Applicant: Darrell Cook, La Mirada, CA (US)

(72) Inventor: Darrell Cook, La Mirada, CA (US)

( * ) Notice: Subject to any disclaimer, the term of this patent is extended or adjusted under 35 U.S.C. 154(b) by 0 days.

(21) Appl. No.: 15/951,827

(22) Filed: Apr. 12, 2018

(65) Prior Publication Data

US 2018/0327986 A1 Nov. 15, 2018

Related U.S. Application Data

(60) Provisional application No. 62/504,070, filed on May 10, 2017.

(51) Int. Cl.
*E01F 15/08* (2006.01)

(52) U.S. Cl.
CPC ..... *E01F 15/088* (2013.01); *E01F 15/083* (2013.01)

(58) Field of Classification Search
CPC ..... E01F 15/14; E01F 13/022
USPC ..... 404/6; 256/13.1; D25/38
See application file for complete search history.

(56) References Cited

U.S. PATENT DOCUMENTS 4,113,400 A * 9/1978 Smith ..... E01F 15/083 256/13.1
4,496,264 A * 1/1985 Casey ..... E01F 15/086 256/13.1
4,681,302 A * 7/1987 Thompson ..... E01F 8/0035 256/13.1
4,751,893 A * 6/1988 Brantley ..... E01F 7/06 116/63 R
5,217,318 A * 6/1993 Peppel ..... E01F 15/146 256/13.1
5,360,286 A * 11/1994 Russell ..... E01F 15/086 404/6
6,059,491 A * 5/2000 Striefel ..... E01F 15/086 256/13.1
6,203,242 B1 * 3/2001 Englund ..... E01F 15/083 256/13.1
D462,126 S * 8/2002 Englund ..... D25/38.1
6,485,224 B1 * 11/2002 Dyke ..... E01F 15/006 16/250
6,669,402 B1 * 12/2003 Davis ..... E01F 15/086 256/13.1
6,837,647 B2 * 1/2005 Tagg ..... E01F 13/022 256/13.1
7,393,154 B1 * 7/2008 Dyke ..... E01F 15/085 256/13.1
7,416,364 B2 * 8/2008 Yodock, III ..... E01F 15/083 256/13.1
7,566,187 B2 * 7/2009 Dyke ..... E01F 15/006 404/6
7,950,871 B2 * 5/2011 Lass ..... E01F 15/025 404/6

(Continued)

*Primary Examiner* — Thomas B Will
*Assistant Examiner* — Katherine J Chu
(74) *Attorney, Agent, or Firm* — Kenneth L. Green; Averill & Green

(57) ABSTRACT

A K rail end cap is fixed to ends of the K rails to repair chipped K rails or protect the ends of undamaged K rails. The caps are preferably a plastic material or the like, are between 0.093 inches and 0.125 inches thick, and about 9 inches deep. The caps slip over the top, sides, and bottom of the K rail ends, and may be glued in place. An opening in the face of the caps exposes metal loops at each end of the K rails to allow connection of consecutive K rails after the caps are attached.

15 Claims, 3 Drawing Sheets

(56) References Cited

U.S. PATENT DOCUMENTS

| | | | | |
|---|---|---|---|---|
| 8,613,565 | B2 * | 12/2013 | Mustafa | B25B 5/101 404/6 |
| 8,647,012 | B2 * | 2/2014 | Wilkinson | E01F 15/12 256/13.1 |
| 8,777,510 | B2 * | 7/2014 | Maus | E01F 15/086 404/6 |
| 9,133,591 | B2 * | 9/2015 | Maus | E01F 15/086 |
| 9,598,827 | B1 * | 3/2017 | Pavloff, Jr. | E01F 15/083 |
| 9,670,631 | B2 * | 6/2017 | Ditta | E01F 13/022 |
| 2004/0197140 | A1 * | 10/2004 | Maleska | E01F 15/083 404/6 |
| 2007/0253771 | A1 * | 11/2007 | Hotchkin | E01F 15/085 404/6 |
| 2009/0035059 | A1 * | 2/2009 | Kohali | E01F 15/083 404/6 |
| 2011/0091273 | A1 * | 4/2011 | Sayre | C08G 18/10 404/6 |
| 2014/0334875 | A1 * | 11/2014 | Hoffman | E01F 15/083 404/6 |

* cited by examiner

K RAIL END CAP

CROSS-REFERENCE TO RELATED APPLICATIONS

The present application claims the priority of U.S. Provisional Patent Application Ser. No. 62/504,070 filed May 10, 2017, which application is incorporated in its entirety herein by reference.

BACKGROUND OF THE INVENTION

The present invention relates to K rails used along highways, and in particular to repairing damaged K rails.

K rails are large heavy temporary barriers commonly positioned along highways during construction to re-direct traffic, and also used to control flooding during heavy rain. The K rails are made from concrete, about 20 feet long, weigh about 8,000 pounds, and are subject to chipping when impacted. Even a small amount of chipping may result in the K rail being unsuitable for further use. Because of the concrete construction, the K rails are not repairable, and due to the size and weight are difficult to dispose of. Thus a need to repair K rails is needed.

BRIEF SUMMARY OF THE INVENTION

The present invention addresses the above and other needs by providing a K rail end cap fixed to ends of K rails to repair chipped K rails or protect the ends of undamaged K rails. The caps are preferably a plastic material or the like, are between 0.093 inches and 0.125 inches thick, and about 9 inches deep. The caps slip over the top, sides, and bottom of the K rail ends, and may be glued in place. An opening in the face of the caps exposes metal loops at each end of the K rails to allow connection of consecutive K rails after the caps are attached.

In accordance with one aspect of the invention, there is provided a K rail cap allowing protection and repair of K rail ends. The K rails are made of brittle concrete, and may chipped upon an impact. The caps both protect the K rail ends from chipping, and provide an inexpensive repair for chipped K rail ends.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1A:
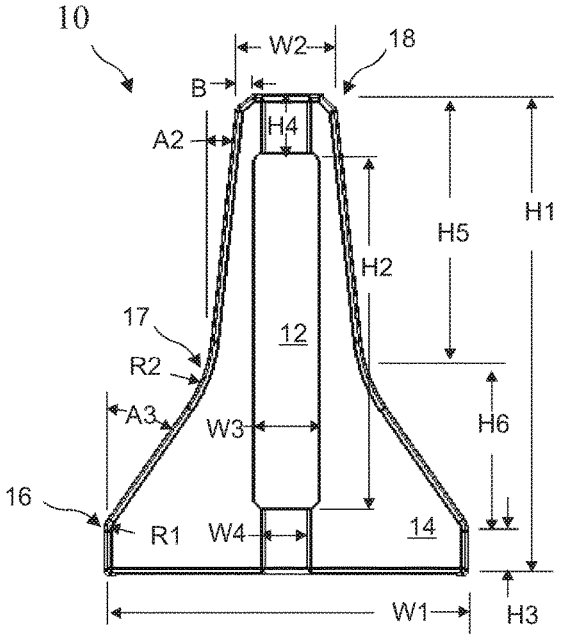
FIG. 1A is a front view of a K rail cap according to the present invention.
Figure 1B:
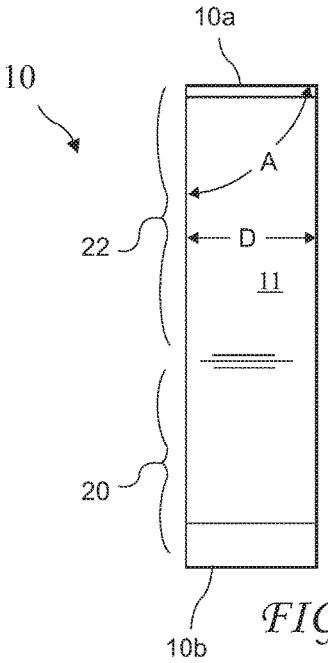
FIG. 1B is a side view of the K rail cap according to the present invention.
Figure 2A:
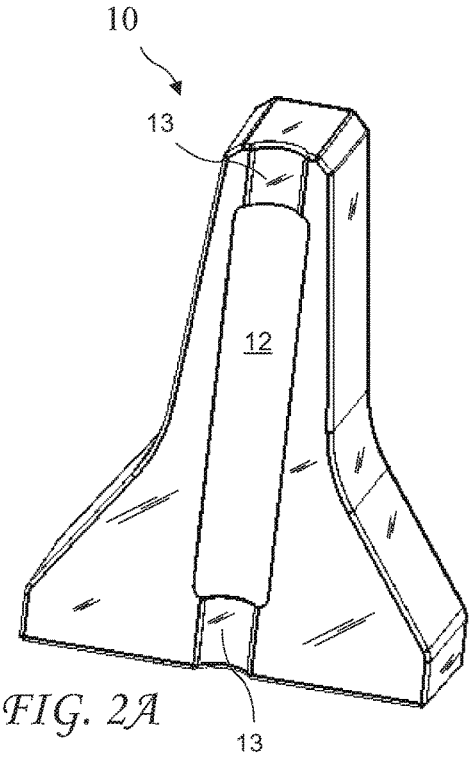
FIG. 2A is a front-side isometric view of the K rail cap according to the present invention.
Figure 2B:
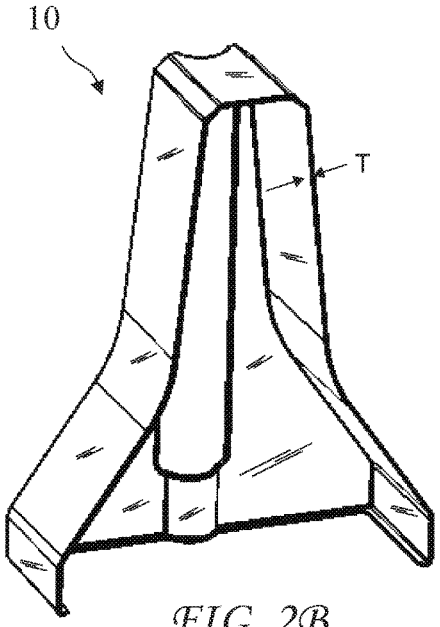
FIG. 2B is a rear-side isometric view of the K rail cap according to the present invention.

A front view of a K rail cap 10 according to the present invention is shown in FIG. 1A, a side view of the K rail cap 10 is shown in FIG. 1B, a front-side isometric view of the K rail cap 10 is shown in FIG. 2A, and a rear-side isometric view of the K rail cap 10 is shown in FIG. 2B. The K rail cap 10 defines a tapered base portion 20, a top portion 22 and is dimensioned to slide over an end 32 of a K rail 30 (see FIG. 3). The K rail cap 10 is preferably made of plastic or similar material, for example polystyrene or Acrylonitrile butadiene styrene (ABS) plastic, or High Density Polyethylene (HDPE). The K rail cap 10 is preferably of uniform thickness between 0.093 and 0.130 inches, and preferably 0.130 inches, and preferably has a glue line of about 0.060 inches between the K rail cap 10 and the end of the K rail 30. The K rail cap 10 has substantially the same shape as a K rail cross-section, allowing some variation associated with molding the K rail cap 10 and variations in the K rail cross-sections. In general the K rail cap 10 inside dimensions provide about a 0.22 inch clearance around the profile of the exterior of the K rail 30.

In one embodiment for a common K rail, the K rail cap 10 has a height H1 of about 32.7 inches, a bottom width W1 of about 24.7 inches, a top width W2 of about 6.7 inches, and a skirt 11 having a depth D of about 9.13 inches. A lower corner 16 is about a height H3 of about three inches above the bottom 10*b*, and preferably has a convex radius R1 of preferably about one inch, a waist 17 has a concave radius R2 of preferably about ten inches, and a top corner 18 has a bevel B with depth and height of about 0.75 inches on each side of a top 10*a*. The top 10*a* of the K rail 10 is slightly tilted above horizontal, for example at an angle A from a vertical face 14 face to the top 10*a* is greater than 90 degrees and preferably about 91 degrees. In general, the K rail cap 10 is sized to provide about a 0.22 inch spacing between the K rail cap 10 and the K rail 30 for glue.

The K rail cap has a tapered top portion 22 having a height H5 of about 19.4 inches and tapered at an angle A2 of about 6 degrees and a tapered bottom portion 20 having a height H6 of about 10.2 inches and tapered at an angle A3 of about 35 degrees.

The K rail cap 10 has an opening 12 through the face 14 between recessed access openings 13 and generally centered on connecting features 34 (see FIGS. 4A and 4B) of a K rail 30 (see FIG. 3) allowing the connecting features 34 to reach through the K rail cap 10. Access openings 13 are present above and below the opening 12 and reach between the opening 12 and the top 10*a* and bottom 10*b* of the K rail cap 10 and preferably having a width of about 3.2 inches. The opening 12 has a height H2 of about 24.25 inches and a width W3 of about 4.5 inches, and is spaced down from the top of the K rail cap 10 a height H4 to provide access to connecting features 34 (see FIG. 3) on the K rail ends 32 to allow connecting consecutive K rails 30 after attaching the K rail caps 10 to the K rails 30.

The dimensions of the K rail cap 10 may vary depending on the dimensions of a particular K rail design, and a K rail cap configured to fit over the end of any K rail or equivalent concrete structure and provide clearance for fitting over the K rail end and for glue, for example 0.22 inch clearance, is intended to come within the scope of the present invention.

Figures 3, 4A, 4B:
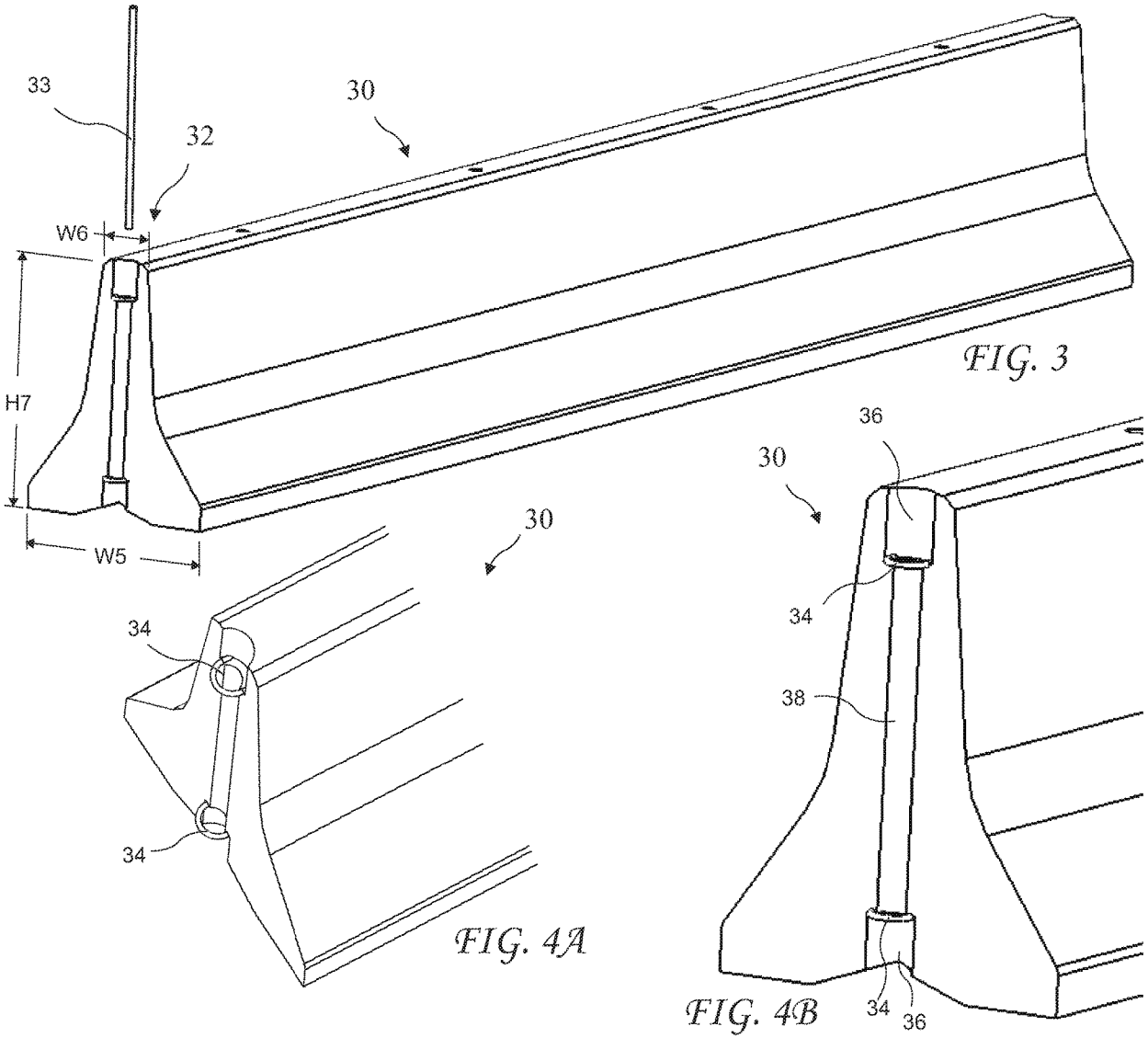
FIG. 3 shows a K rail without a K rail cap according to the present invention.
FIG. 4A shows a first detailed view of an end of the K rail.
FIG. 4B shows a second detailed view of an end of the K rail.

The K rail 30 with a K rail cap is shown in FIG. 3, a first detailed view of an end 32*a* of the K rail 30 is shown in FIG. 4A, and a second detailed view of an end 32*a* of the K rail 30 is shown in FIG. 4B. The K rail 30 includes connecting features 34 on the K rails ends 32 for connecting consecutive K Rails. The connecting features 34 are preferably metal loops embedded in the concrete K rails 30. Access passages 36 are above an below a center passage 38. When K rails 30 are arrange end to end, a rod 33 may be inserted through the access passages 36, the connecting features 34, and the center passages 38 to connect the K rails. Known K rails have a designed height H7, a bottom width W5 and a top width W6. The height H5 is 32 inches, the width W5 is 24 inches, and the width W6 is 6 inches. The dimensions of actual K rails varies based on manufacturing, temperature, and other physical factors, and the K rail cap 10 is designed accommodate such variations.

Figure 5:
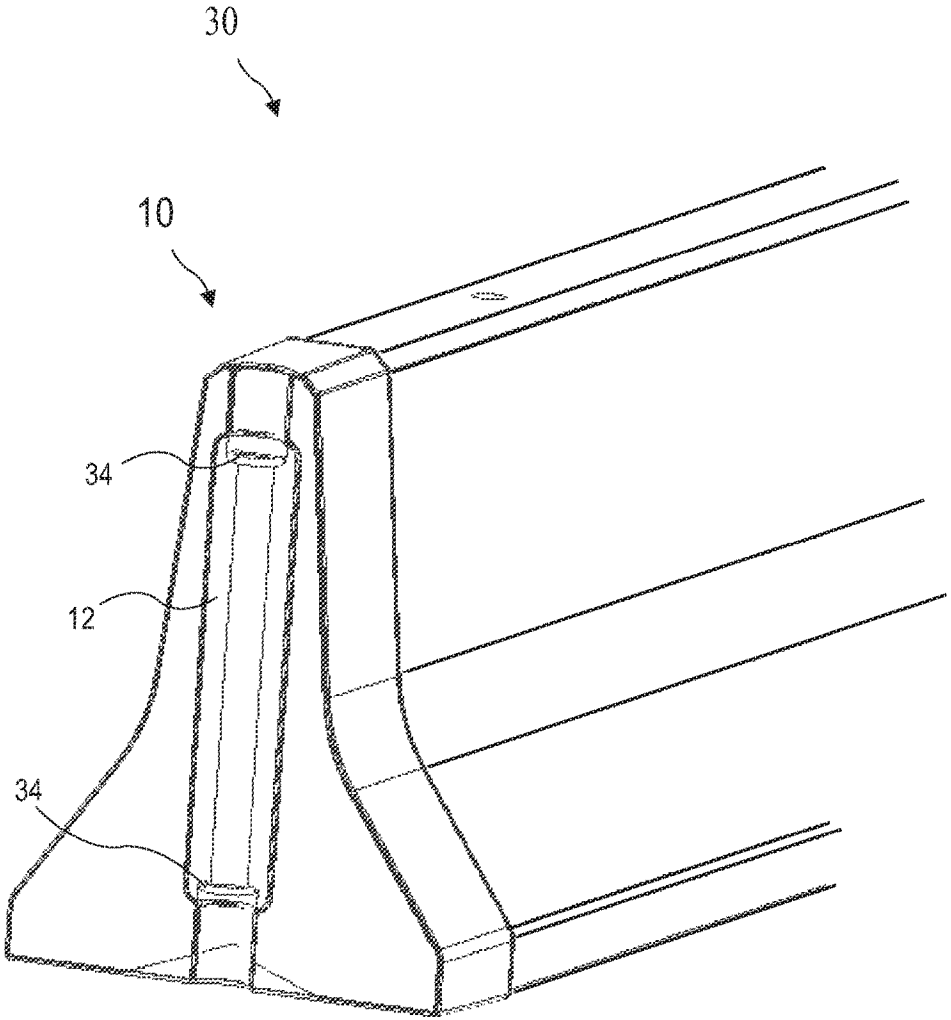
FIG. 5 shows the K rail caps on a K rail.

The K rail caps 10 are shown on a K rail 30 in FIG. 5. The connecting features 34 on the K rails ends 32 are exposed through the opening 12 and access openings 13 in the K rail caps 10 to allow connecting the K rails 30 after the K rail caps 10 are attached to the K rails 30.

Figure 6:
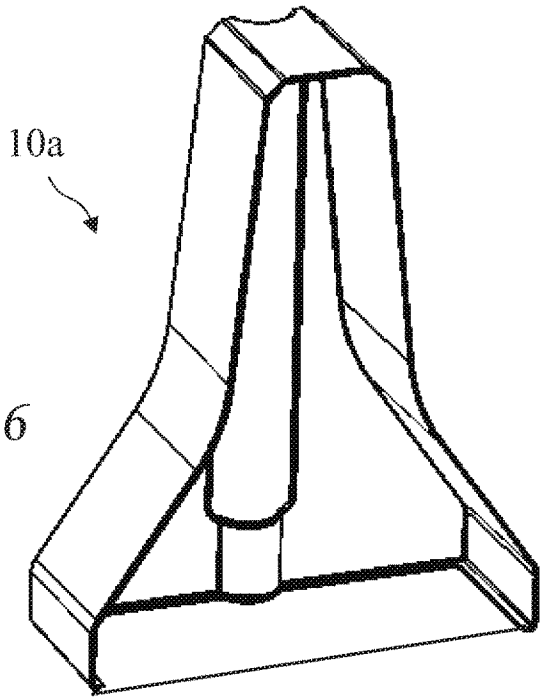
FIG. 6 shows an inside view of the K rail cap.

A K rail cap 10*a* with closed bottom is shown in FIG. 6. Other than the closed bottom, the K rail cap 10*a* includes the features of the K rail cap 10.

While the invention herein disclosed has been described by means of specific embodiments and applications thereof, numerous modifications and variations could be made thereto by those skilled in the art without departing from the scope of the invention set forth in the claims.

I claim:

1. A K rail cap, comprising:

a face having substantially a same shape as a cross-section of a K rail;

a skirt reaching back from the face and including a top and sides and configured to slide over an end of a K rail enclosing an end of the K rail;

an vertical connecting feature opening in the face to access connecting features on ends of the K rails; and a recessed access opening reaching from the vertical opening to the top to allow a rod to be inserted vertically down through the connecting features of two consecutive K rails to connect the two consecutive K rails.

2. The K rail cap of claim 1, wherein the skirt is sized to provide about a 0.22 inch clearance around the K rail end for glue and to accommodate manufacturing variations in the K rails.

3. The K rail cap of claim 1, wherein the top of the skirt is angled up above the horizontal an angle A from vertical, reaching back from the face of the K rail cap.

4. The K rail cap of claim 3, wherein the top of the skirt is angled up about one degree above the horizontal reaching back from the face of the K rail cap.

5. The K rail cap of claim 1, wherein the K rail cap is between 0.093 and 0.130 inches thick.

6. The K rail cap of claim 5, wherein the K rail cap is 0.130 inches thick.

7. The K rail cap of claim 1, wherein the K rail cap is about 32.7 inches high, about 24.7 inches wide at the bottom, and about 6.7 inches wide at the top.

8. The K rail cap of claim 7, wherein the K rail cap has a tapered top portion with a height of about 19.4 inches and tapered at an angle of about 6 degrees and a tapered bottom portion below the top portion and having a height of about 10.2 inches and tapered at an angle of about 35 degrees.

9. The K rail cap of claim 1, wherein the connecting feature opening has a height of about 24.25 inches and a width of about 4.5 inches.

10. The K rail cap of claim 1, wherein the K rail cap is made of plastic.

11. The K rail cap of claim 1, wherein the K rail cap is made of High Density Polyethylene (HDPE).

12. A capped K rail, comprising:

a concrete K rail comprising:

a length;

a height of about 32 inches;

a bottom width of about 24 inches;

a top of about 6 inches;

a top portion tapered at about 6 degrees from the vertical;

a bottom portion below the top portion and tapered at about 35 degrees from the vertical;

opposite ends; and two connecting loops embedded in each end of the K rail;

a K rail cap made of plastic and glued to one of the ends of the K rail and comprising:

a face having substantially a same shape as a cross-section of the K rail;

a skirt reaching back from the face and including a top and sides and configured to slide over an end of a K rail enclosing an end of the K rail;

an vertical connecting feature opening in the face to access connecting features on ends of the K rails; and a recessed access opening reaching from the vertical opening to the top to allow a rod to be inserted vertically down through the connecting features of two consecutive K rails to connect the two consecutive K rails;

wherein the K rail cap has a clearance sufficient to slide the K rail cap over the K rail and glue the K rail cap to the K rail.

13. The K rail cap of claim 12, wherein the skirt is sized to provide about a 0.22 inch clearance around the K rail end for glue and to accommodate manufacturing variations in the K rails.

14. The K rail cap of claim 12, wherein the K rail cap is made of High Density Polyethylene (HDPE) plastic.

15. A capped K rail, comprising:

a concrete K rail comprising:

a length;

a height of about 32 inches;

a bottom width of about 24 inches;

a top of about 6 inches;

a top portion tapered at about 6 degrees from the vertical;

a bottom portion below the top portion and tapered at about 35 degrees from the vertical;

opposite ends; and two connecting loops embedded in each end of the K rail;

a K rail cap made of High Density Polyethylene (HDPE) and glued to one of the ends of the K rail and comprising:

a face having substantially a same shape as a cross-section of the K rail;

a skirt reaching back from the face and including a top and sides and configured to slide over an end of a K rail enclosing an end of the K rail, the skirt sized to provide about a 0.22 inch clearance around the K rail end for glue and to accommodate manufacturing variations in the K rails;

an vertical connecting feature opening in the face to access connecting features on ends of the K rails; and a recessed access opening reaching from the vertical opening to the top to allow a rod to be inserted vertically down through the connecting features of two consecutive K rails to connect the two consecutive K rails;

wherein the K rail cap has a clearance sufficient to slide the K rail cap over the K rail and glue the K rail cap to the K rail.

* * * * *